US006223941B1

(12) United States Patent
Nealey

(10) Patent No.: US 6,223,941 B1
(45) Date of Patent: May 1, 2001

(54) APPLICATOR FOR DISPENSING A SOFT PACKAGE OF MATERIAL

(75) Inventor: Michael S. Nealey, Renton, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/357,087

(22) Filed: Jul. 19, 1999

(51) Int. Cl.[7] ..... B67D 5/00

(52) U.S. Cl. ..... 222/82; 222/105; 222/325; 222/327; 222/389

(58) Field of Search ..... 222/23, 82, 95, 222/105, 153.09, 153.14, 325, 326, 327, 386.5, 387, 389, 568

(56) References Cited

U.S. PATENT DOCUMENTS

| | | | | |
|---|---|---|---|---|
| 1,604,434 | * | 10/1926 | Welcl et al. | 222/389 |
| 3,433,134 | * | 3/1969 | Vellekoop | 222/389 |
| 3,439,839 | * | 4/1969 | Schumann et al. | 222/568 |
| 4,453,651 | * | 6/1984 | Braithwaite et al. | 222/82 |
| 4,703,875 | * | 11/1987 | Malek | 222/386.5 |
| 4,997,107 | * | 3/1991 | Snyder et al. | 222/568 |
| 5,161,715 | | 11/1992 | Giannuzzi | 222/82 |
| 5,279,569 | * | 1/1994 | Neer et al. | 604/154 |
| 5,301,835 | * | 4/1994 | Fulks et al. | 222/95 |
| 5,368,206 | * | 11/1994 | Sandrin | 222/326 |
| 5,536,531 | | 7/1996 | Owen et al. | 427/256 |
| 5,558,277 | | 9/1996 | Owen et al. | 239/322 |
| 5,680,967 | * | 10/1997 | Dang et al. | 222/327 |

FOREIGN PATENT DOCUMENTS

| | | | | |
|---|---|---|---|---|
| 4226956 | * | 2/1994 | (DE) | 222/389 |
| 1435053 | * | 5/1976 | (GB) | 222/389 |

* cited by examiner

*Primary Examiner*—Kevin Shaver
*Assistant Examiner*—Melvin A Cartagena
(74) *Attorney, Agent, or Firm*—Lawrence W. Nelson

(57) ABSTRACT

An apparatus that dispenses material stored in a soft packet. The apparatus includes a barrel sized to contain the soft packet. The barrel has a front end and a back end. The apparatus also includes a cap removably engaged to the front end of the barrel. The cap has an orifice through which the material may flow. The cap also has inner dimensions sized to form a seal with a top portion of the soft packet to minimize any extraneous air trapped therebetween. The apparatus further includes a plunger positioned within the barrel. The plunger applies pressure to the soft packet when the plunger moves from the back end of the barrel toward the front end of the barrel to force the material out from the packet and through the orifice.

5 Claims, 9 Drawing Sheets

APPLICATOR FOR DISPENSING A SOFT PACKAGE OF MATERIAL

BACKGROUND OF THE INVENTION

1. Field of the Invention

The present invention relates to an applicator of viscous and non-viscous material, and more particularly to a dispensing gun for applying sealants and adhesives.

2. Background Information

In the field of aircraft production and maintenance, adhesives and sealants are continuously being applied to aircraft components. Sealants are used on many of the components of an aircraft to insure that the aircraft's cabin maintains a near-standard air pressure, even at elevations as high as 60,000 feet. Sealants are also used to prevent fuel leakage from wing tanks on an aircraft.

To apply different sealant products, some form of application technology is required when producing an aircraft. For many years, applicator guns were used in the aerospace industry. An applicator gun 300, as shown in FIG. 1, uses a solid plastic tube 301 made of low-density polyethylene for holding a sealant. Each tube 301 includes a plunger surface 302, a casing 304, and a disposable cap 306. The applicator gun 300 has a metal holder 310 for holding the tube 301 against a pressure-applying assembly 314. The applicator gun 300 also has a knob 308 coupled with the pressure-applying trigger 309 on the assembly 314.

To load the tube 301 into the applicator gun 300, an operator unscrews the knob 308 and disengages the pressure applying assembly 314. The tube 301 is loaded into the metal holder 310 and the assembly 314 is reattached to the metal tube 310. The cap 306 on the tube 301 is removed and discarded to allow egress of the sealant contained in the tube 301. The nozzle 311 is attached to aid in flow control. The sealant is applied by squeezing the trigger 309, causing the assembly 314 to pressure up with compressed air against the back of the plunger surface 302, moving it forward. The movement of the plunger surface 302 forces the sealant out of the nozzle 311. Removal of the spent tube 301 is accomplished in the same manner as its installation, only in reverse.

Unfortunately, the sealant applicator gun 300 uses disposable cartridges, which are made of hard plastic material. As such, they are not easily compressible, and generate large amounts of hazardous waste, which must be disposed of at high cost. Further, the present method of using hard plastic tubes decreases productivity because of the extensive amount of time necessary to both fill the tubes and then manually swap them once one has been emptied. Finally, the size of the hard tube is not easily varied, and each tube is relatively expensive to produce. Consequently, there is a need in the art for an inexpensive and rapid device for applying sealant, which produces a minimal amount of hazardous waste.

SUMMARY OF THE INVENTION

In accordance with one embodiment, an apparatus is used to dispense material stored in a soft packet. The apparatus includes a barrel sized to contain the soft packet, the barrel having a front end and a back end, and a cap removably engaged to the front end of the barrel. The cap has an orifice through which the material may flow, and has inner dimensions sized to form a seal with a top portion of the soft packet to minimize any extraneous air trapped therebetween. The apparatus also has a plunger positioned within the barrel.

The plunger applies pressure to the soft packet when it moves from the back end of the barrel toward the front end of the barrel to force the material out from the packet and through the orifice.

BRIEF DESCRIPTION OF THE DRAWINGS

The present invention will be further described with reference to the accompanying drawings wherein like referenced numerals refer to like parts in the several views, and wherein.

DETAILED DESCRIPTION OF THE INVENTION

Figure 1:
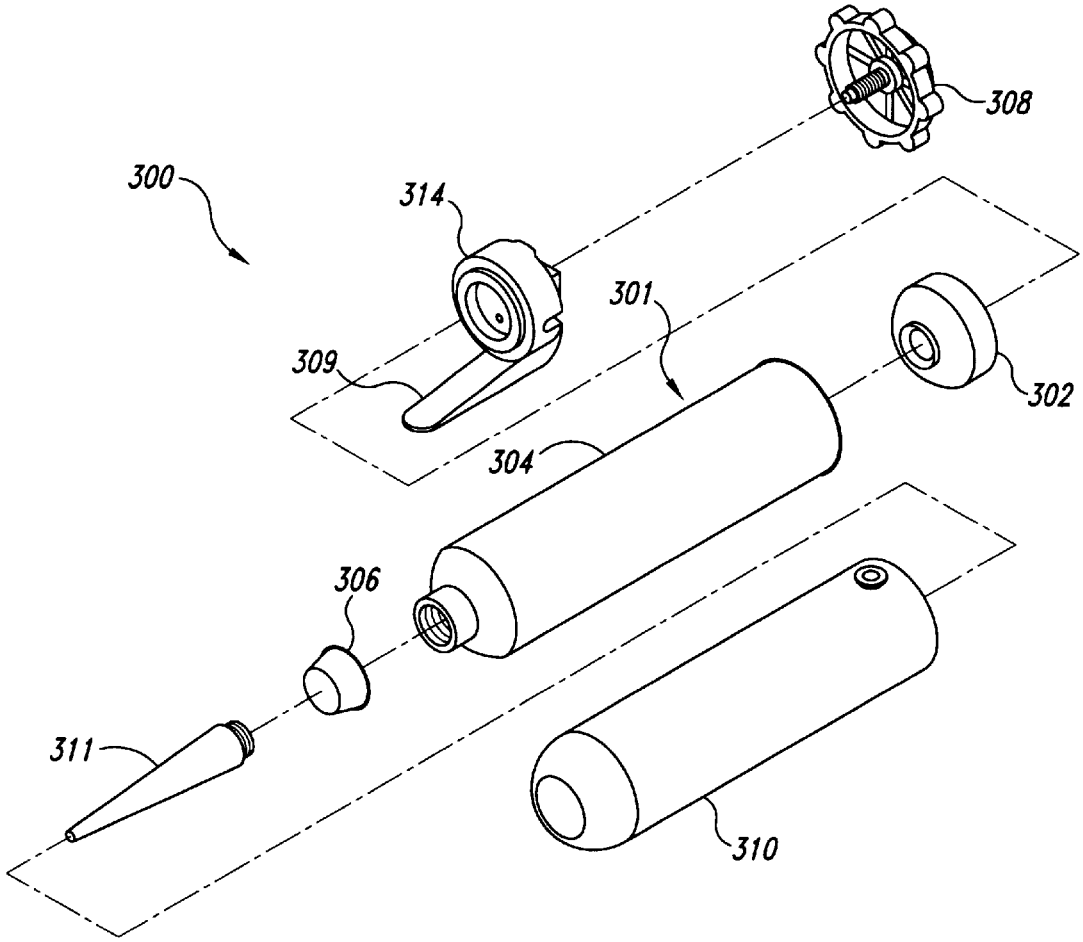
Fig. 1 (Prior Art)
FIG. 1 is an exploded view of a prior art sealant gun.
Figure 2:
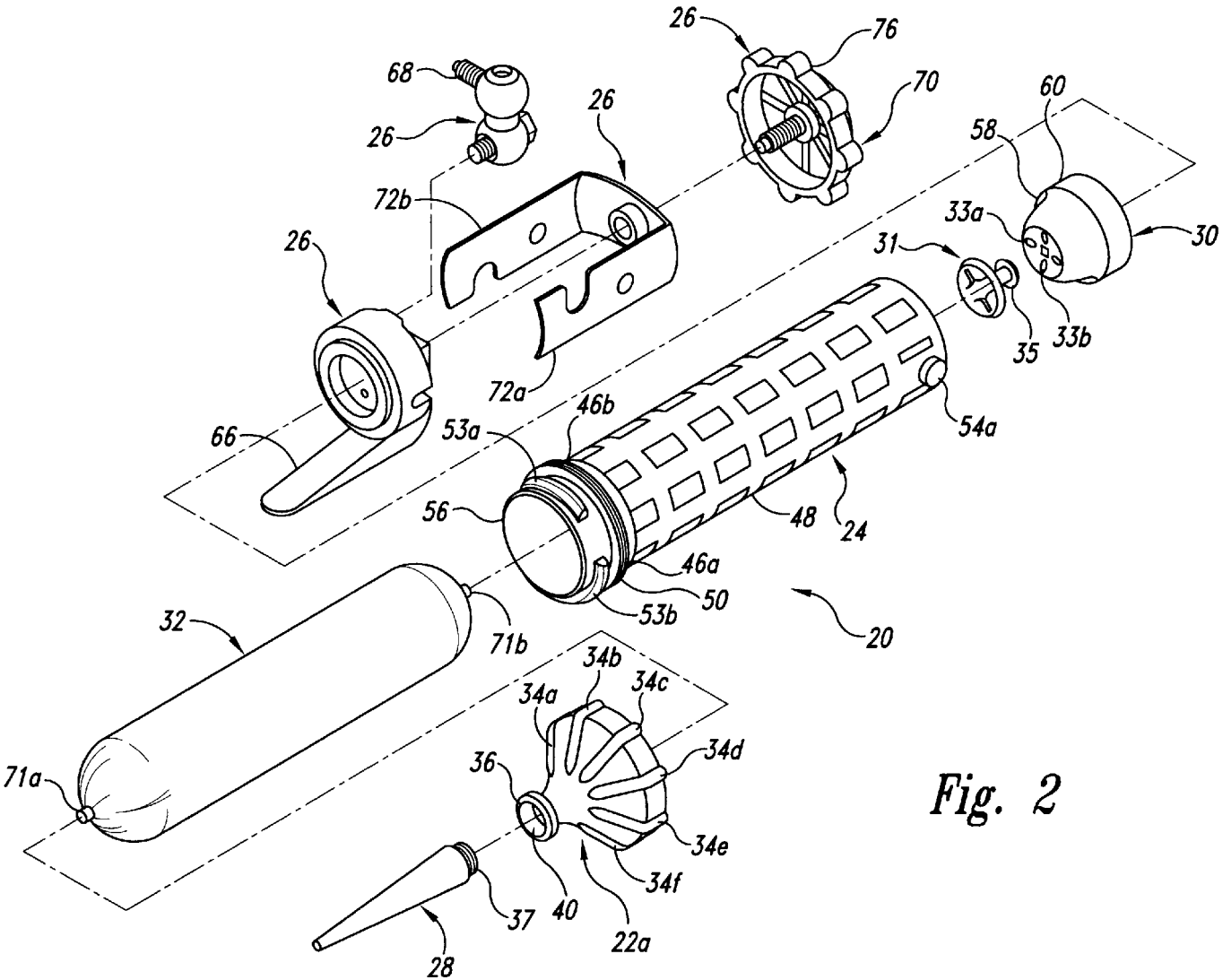
FIG. 2 is an exploded view of an applicator for dispensing a soft packet of material according to a first embodiment of the present invention.

The present invention relates to an applicator 20 for dispensing either viscous or nonviscous materials stored in a soft packet 32, as shown in FIG. 2. The applicator 20 reduces waste by replacing bulky, expensive hard plastic containment tubes with the soft packets 32, otherwise known as "Chub packs." The soft packets can easily be varied in size, typically ranging from two to six ounces. The soft packets 32 can be replaced at least six times faster than the prior art hard plastic containers. Further, the use of soft packets allows either the viscous or non-viscous materials to be flash frozen, allowing the materials to be stored for long periods of time. The either viscous or non-viscous materials include, but are not limited to, sealants, lubricants, adhesives, and potting compounds.

In a first embodiment, the applicator 20 includes a cap 22, a barrel 24, a pressurizing valve assembly 26, a nozzle tip 28, and a plunger 30 used in conjunction to apply the material that is held in the soft packet 32 to a desired location.

Figure 3A:
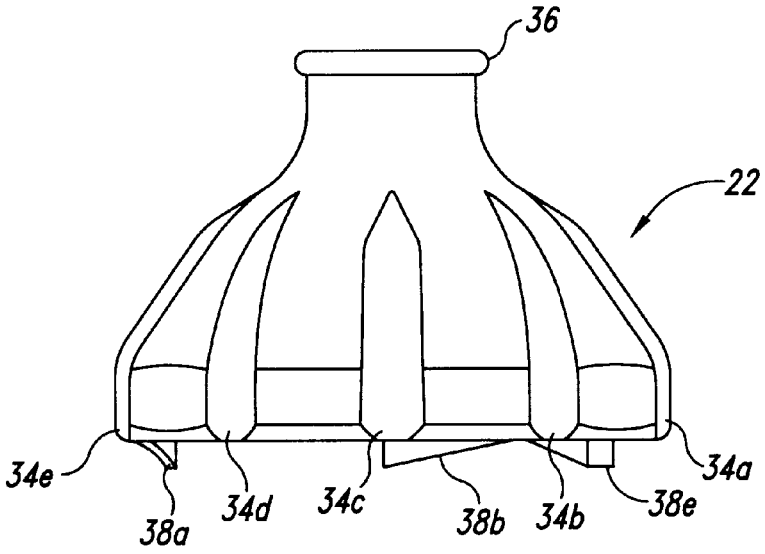
FIG. 3A is a side view of a locking cap of the applicator according to the first embodiment.
Figure 3B:
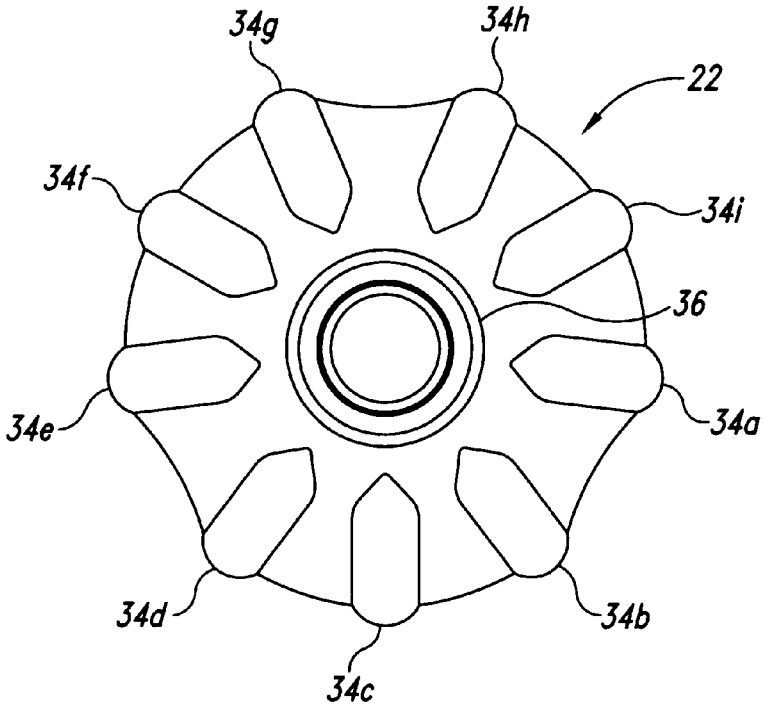
FIG. 3B is a top view of the locking cap of the applicator according to the first embodiment.

The cap 22 of the applicator 20, as shown in FIGS. 3A and 3B, includes nine ribs 34*a*–34*i*, spaced in three groups of three ribs each, around the cap 22. The ribs 34*a*–34*i* are positioned to assist an operator in gripping the cap 22 when attempting to attach or disengage the cap 22 from the barrel 24. As further shown in FIGS. 3A and 3B, the cap 22 also has an end-of-nozzle lip 36 that provides structural support for the end portion of the cap 22 which tends to receive a large amount of pressure when engaged to the nozzle tip 28. The cap 22 and barrel 24 are preferably made of acetocopolymer M90, made by CELCON®. The M90 was chosen since it was found that most sealants do not stick to it.

Figure 4:
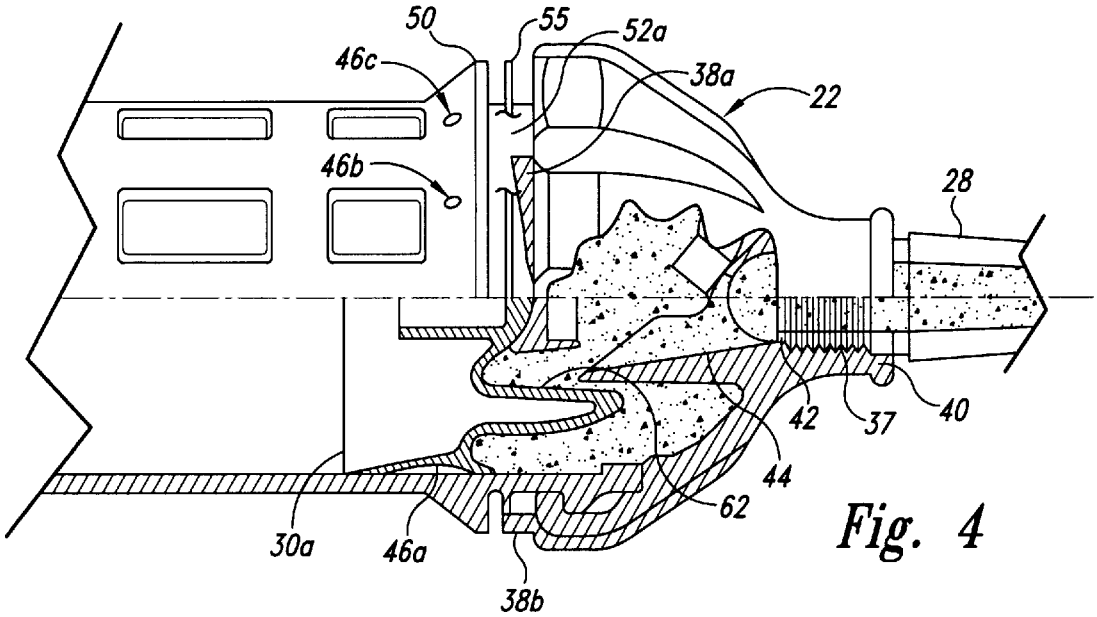
FIG. 4 is a partial cross-sectional view of the cap and a forward portion of the applicator according to the first embodiment.

As shown in FIG. 4, the nozzle tip 28 is attached to the cap 22 by a threading nozzle threads 37 of the nozzle tip 28 into a threaded interior 40 of the cap 22. Preferably, the nozzle tip 28 comes in various sizes allowing control over the diameter of the bead of the material applied to a surface. The nozzle tip 28 also allows the operator some degree of control over the flow rate of the material. Of course, each size of the nozzle tips 28 preferably has the same diameter nozzle threads 37 to engage the threaded interior 40 of the cap 22.

As shown in FIG. 4, the threaded interior 40 includes a flat edge 42. The flat edge 42 is located at the end of the threaded interior 40, and allows removal of cured material, such as residual sealant, from the end of the cap 22. By removing the end of the nozzle tip 28, the operator can pull on the residue sealant. The lack of threading causes a break to occur at the flat edge 42 and the residual sealant can be pulled away from the threaded interior 40.

Figure 5A:
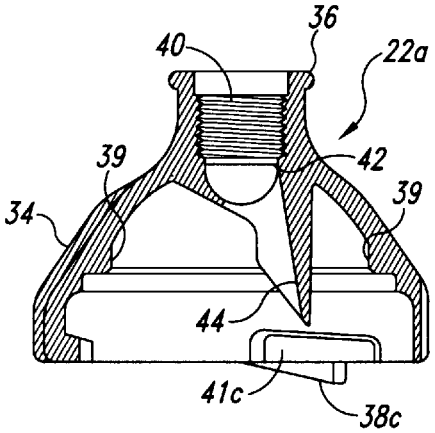
FIGS. 5A and 5B are cross-sectional views of the locking cap at a first and second angle, respectively, of the applicator according to the first embodiment.
Figure 5B:
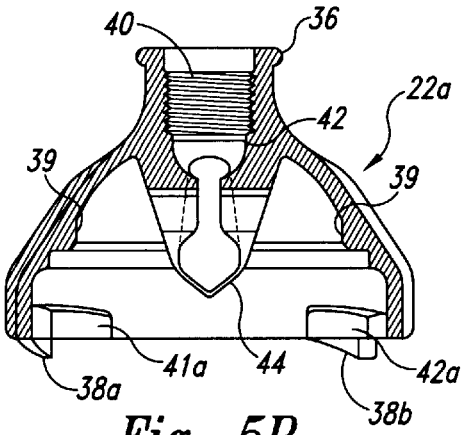

The cap 22, as shown in FIGS. 4, 5A, and 5B, also includes a dagger 44 used to puncture the soft packet 32 and allow the material to flow towards the nozzle tip 28. The dagger 44 is positioned to prevent the soft packet 32 from clogging the flow path of the material. The cap 22 has a narrowing neck 39 which is slightly smaller in diameter than the packet 32. The shape of the neck 39 creates and maintains a tight seal between the packet 32 and the cap 22. The seal between cap 22 and the packet 32 has the function of controlling the sealant so it does not leak back into the barrel 24 of the applicator 20.

Figure 6:
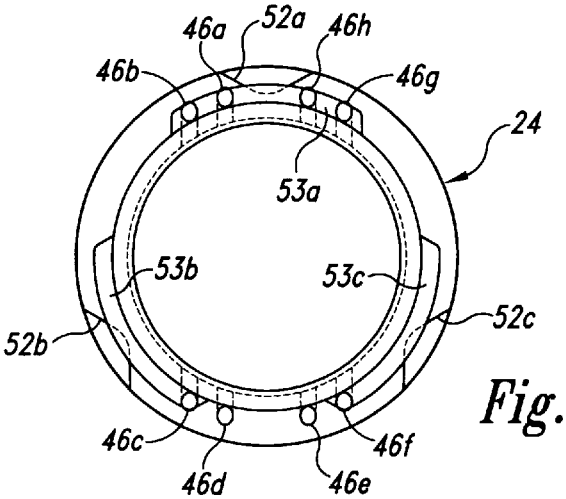
FIG. 6 is a top view of the barrel according to the first embodiment.

As shown in FIGS. 5A, 5B, and 6, the bottom of the cap 22 has a first, second, and third ramping tongue 38*a*–38*c*, respectively, each spaced 120° about the cap's centerline. The tongues 38*a*–38*c* are used for precisely locating the cap 22 on the barrel 24. The tongues 38*a*–38*c* lock the cap 22 onto the barrel 24, shown in FIGS. 5A and 7, when they respectively engage the cap 22 to three self-locking grooves 52*a*–52*c* of the barrel 24. The three self-locking grooves 52*a*–52*c* are provided in a thin lip 55 above the tapered edge 50, as shown in FIGS. 4 and 6. The grooves 52*a*–52*c* provide an audible and visual check to inform the operator that the threads are fully engaged. The tongues 38*a*–38*c*, shown in FIG. 3A, at the bottom edge of the cap 22, drop down into the grooves 52*a*–52*c* and are aligned with the center of the respective grooves 52*a*–52*c*. The alignment of the tongues 38*a*–38*c* with the respective grooves 52*a*–52*c* provides a visual indication that cap 22 is fully aligned. Once the cap 22 no longer twists onto the barrel 24, indents 38*a*–38*c* should be centered in the grooves 52*a*–52*c* of the barrel 24.

The barrel 24 has bayonet mounting tabs 53*a*–53*c*, shown in FIG. 6, which retain the cap 22 onto the barrel 24. The mounting tabs 53*a*–53*c* overlappingly engage with respective cap tabs 41*a*–41*c*, shown in FIGS. 5A and 5B, as the cap 22 is turned to align the tongues 38*a*–38*c* with the respective grooves 52*a*–52*c*.

As shown In FIGS. 4 and 6, the tapered edge 50 has eight vent holes 46*a*–46*h* therein to provide airflow between the inside of the barrel 24 and the outside of the barrel 24. The vent holes 46*a*–46*h* relieve trapped air between the soft packet 32 and the interior of the barrel 24 when the applicator 20 is being used. The vent holes 46*a*–46*h* also eliminate the chance that air will pass out of the nozzle tip 28 along with the material and interfere with its application onto a surface. The vent holes 46*a*–46*h* are positioned so that it is difficult for the operator to inadvertently cover the holes 46*a*–46*h* and stop the outward flow of air.

The tapered edge 50 containing the vent holes 46*a*–46*h* reinforces the holes and assists in the support, handling and use of the applicator 20. The tapered edge 50 further reduces the sharp edges associated with the end of the barrel 24, and prevents operator contact with the edge of the cap 22. The tapered edge 50 also reduces the chance of the viscous fluid dripping onto the outside of the barrel 24.

Figure 7:
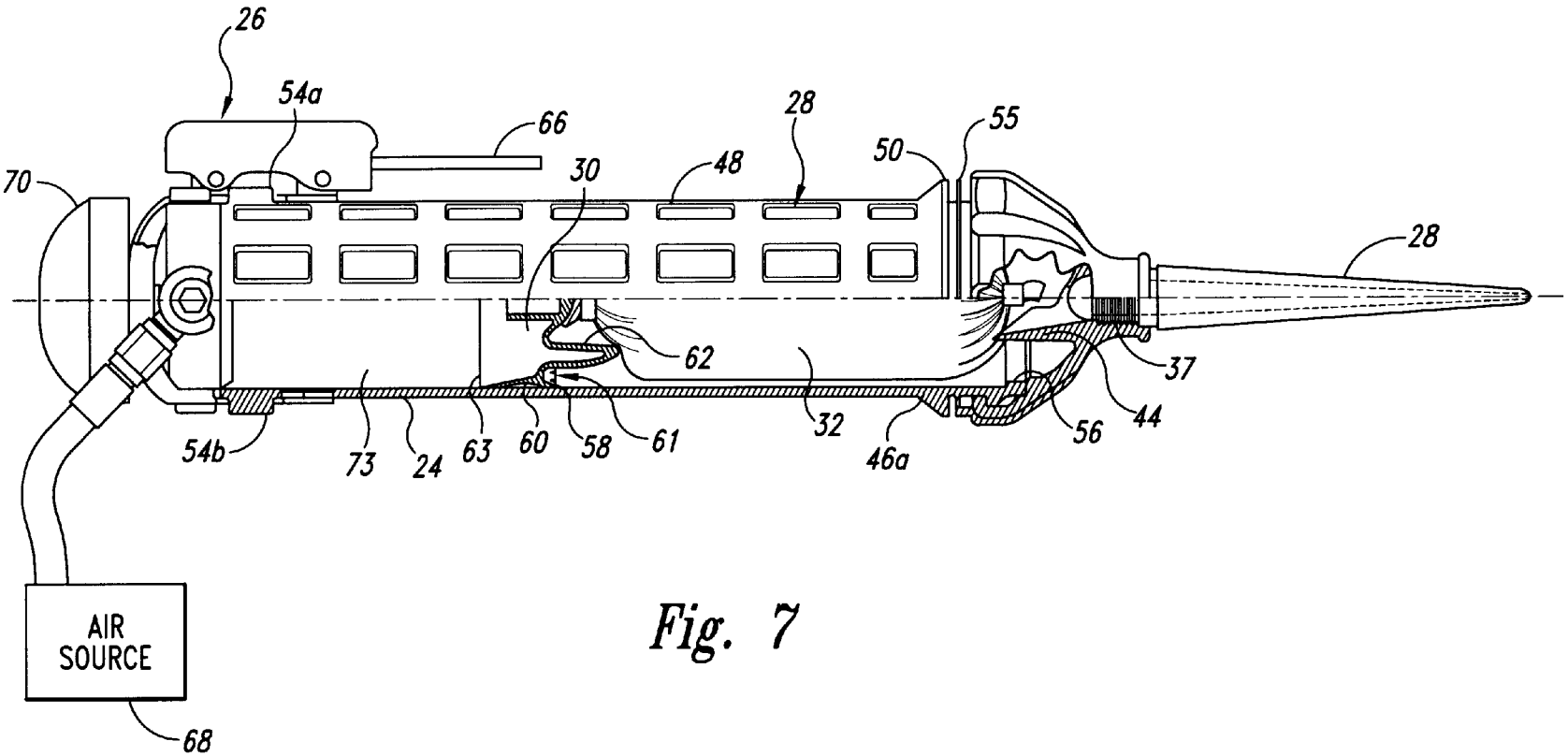
FIG. 7 is a cross-sectional view of the applicator according to the first embodiment.

As shown in FIG. 7, the barrel 24 has ribbing 48 on its outside surface. The ribbing 48 provides additional structural support to keep the barrel 24 from expanding in diameter when pressurized with air. The ribbing 48 is also ergonomic in shape and contour and serves as a comfortable hand-holding surface.

FIGS. 2 and 7 show the pressurizing valve assembly 26. Two lugs 54*a* and 54*b* extend from the barrel 24, and are hooked to the assembly 26 via hooks 72*a* and 72*b*. A knob 76 on the assembly 26, as shown in FIGS. 2 and 7, tightens and loosens the hooks 72*a* and 72*b*. When the knob 76 is turned clockwise, the two hooks 72*a* and 72*b* are drawn in and engage the lugs 54*a* and 54*b*, respectively, pulling the barrel 24 up against the valve assembly 26. This action creates an airtight seal between the barrel 24 and the valve assembly 26. Applicator lever 66 controls the flow of pressurized air between a pressurized air source 68 and an inside portion 73 of the barrel 24, between the back of the barrel 24 and the plunger 30.

The plunger 30, shown in FIGS. 2 and 7, is designed to create a perfect seal with the inside of the barrel 24. The plunger 30 has a scraping edge 58 with notches 61, which provide flexibility while the plunger 30 moves within the barrel 24. The scrapping edge 58 moves the soft packet 32 up along the side wall of the barrel 24. The plunger 30 also has a tapered side wall 60, which tapers in circumference from a bottom edge 63 to the scraping edge 58. The tapered side wall 60 imparts flexibility and reduces side wall drag. A top cavity 62 of the plunger 30 is designed to conform to the inside of the contours of the cap 22, including the dagger 44, as shown in FIG. 4. The hemispherical shape of the top of plunger 30 is such that it fits into the top of the cap 20, eliminating waste in the spent soft packet 32. In other words, the conformity of the plunger 30 to the contoured top cavity 62 forces out most of the material in the soft packet 32 when the plunger 30 is fully extended into the barrel 24. The contoured cavity 62 also allows room for two clips, 71*a* and 71*b*, shown in FIG. 2, which seal the ends of the soft packet 32.

Air pressure is partially regulated by the vent holes 33*a*–*g* within the plunger 30 and a valve 31, which is attached to the plunger 30 via a nipple 35 at one end, as shown in FIG.

2. The valve 31 is preferably made of RTV Silicon. The vent holes 33*a*–33*g* are used to vent the pressure behind the plunger 30 so that it does not move while the cap 22 is not attached and the soft packet is not loaded into the barrel 24. The nipple 35 is shaped with a dull point on it for easy insertion into the bottom of the plunger 30 during assembly. The top of the valve 31 has a recess in it to allow for the clip 71*a* or 71*b* to reside within. The valve 31 acts to relieve pressure behind the plunger 32 when the operator depresses the air valve trigger handle 66.

Once the soft package 32 is inserted into the barrel 24 and the cap 22 is attached, the air pressure behind the plunger 30 moves the plunger 30 which applies force against the soft packet 32. The force behind the plunger 30 and the pressure that is applied against the soft packet 32 is adequate to seal the eight vent holes 33*a*–33*h*. The valve 31 is shaped with a conical section that seats against the eight vent holes 33*a*–33*g* on the top of the plunger 30. There is a raised edge around each vent hole 33*a*–33*g* on the plunger 30 to impart additional sealing of the valve 31 and plunger 30.

After the soft packet 32 is completely empty and the cap 22 is removed, the plunger 30 will be located at its final position and incapable of moving further due to the lip 56. The operator may remove the spent soft packet 32 by depressing the air valve trigger 66, allowing a momentary blast of air to fill the barrel 24 and escape out both the barrel vent holes 46*a*–46*h* and out through the plunger vent holes 33*a*–33*g*, due to the flexible valve 31, which in turn causes the spent soft packet 32 to pop out of the end of the barrel 24 and into a disposal unit.

When operating the applicator 20, it is loaded by removing the cap 22 and forcing the plunger 30 down into the barrel 24. Then, the soft packet 32, filled with a material such as sealant, is inserted into the barrel 24 and the packet 32 is rammed down into the barrel 24 until it bottoms out against the valve assembly 26. The cap 22 is then attached by turning it on the bayonet tabs 53*a*–53*c* of the barrel 24 with approximately one third of a turn clockwise until the ramping tongues 38*a*–38*c* lock into the respective self-locking grooves 52*a*–52*c* on the barrel 24. The threads 37 of the nozzle tip 28, preferably a SEMCO™ nozzle, are threaded into the threaded interior 40 on top of the cap 22 and used for applying the sealant at a specific location on the component 99 to be sealed.

Figure 8:
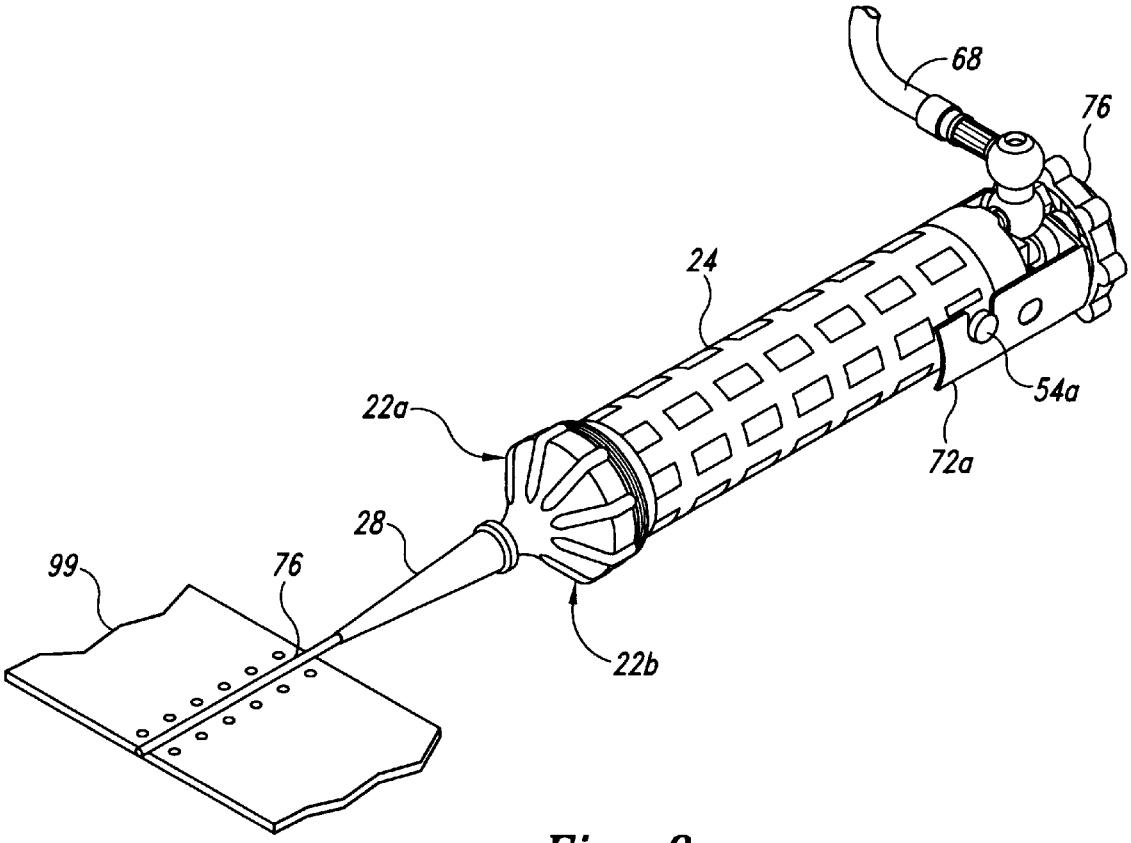
FIG. 8 is a perspective view of the applicator for dispensing the soft packet of sealant, as used in the first embodiment of the present invention.

Once the applicator 20 is loaded, and the pressurizing valve assembly has been attached as described above, the lever 66 on the valve assembly 26 is depressed by hand. Triggering the lever 66 causes air pressure to fill the barrel 24 behind the plunger 30, which moves the soft packet 32 toward the top of the barrel 24, striking the cap 22. Within the cap 22, the soft packet 32 hits the dagger 44. The film-like soft packet 32 breaks and tears on the dagger 44. As the soft packet 32 continues to move forward, the end of it seats at the top of the cap 22. A seal is formed between the soft packet 32 and the cap 22 at the top on a sealing edge 39. Material begins to flow out of the top of the soft package where dagger 44 is located. As the material flows, as shown in FIG. 8, the plunger 30 moves up the barrel 24, collapsing the soft packet 32. As the soft packet 32 collapses, air will tend to build up around the annulus of the soft packet 32 and the barrel 24. The air escapes through the eight vent holes 46*a*–46*h* located on the tapered ring 50 of the barrel 24. After the soft packet 32 is completely empty, the plunger 30 stops at the cap 22. Once the back of the plunger 30 moves past the eight vent holes 46*a*–46*h* and stops on the lip 56 on the barrel 24, compressed air will flow out the eight vent holes 46*a*–46*h* if the applicator lever 66 continues to be pressed, eliminating any further pressure on the soft packet 32.

Once the soft packet 32 is empty, the cap 22 is removed and set down. The spent soft packet 32 will be visibly sticking out of the top of the barrel 24. The operator then removes the spent casing by rolling the soft packet 32 off the plunger 30 and discarding it in a waste container, or uses air pressure as described above.

The soft packet applicator 20 is cleaned by letting the material, such as sealant, set on the applicator 20. Once set, the residue is pealed off the outside of the barrel 24. The cap 22 is cleaned by removing the nozzle tip 28 and pulling out the remaining sealant tail and then carefully scraping the residue from inside the cap 22.

Figure 9:
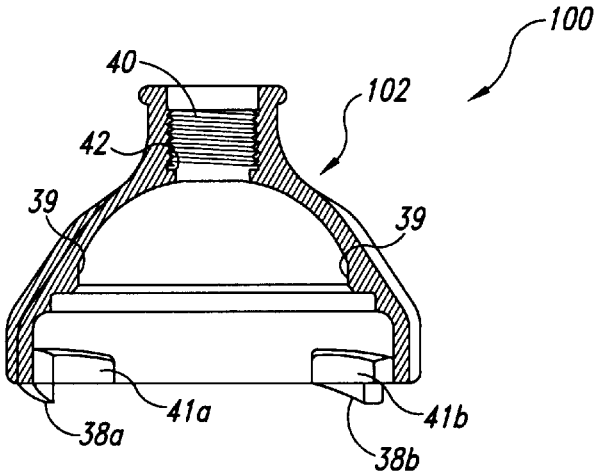
FIG. 9 is a cross-sectional view of a locking cap of an applicator for dispensing a soft packet of material according to a second embodiment of the present invention.
Figure 10:
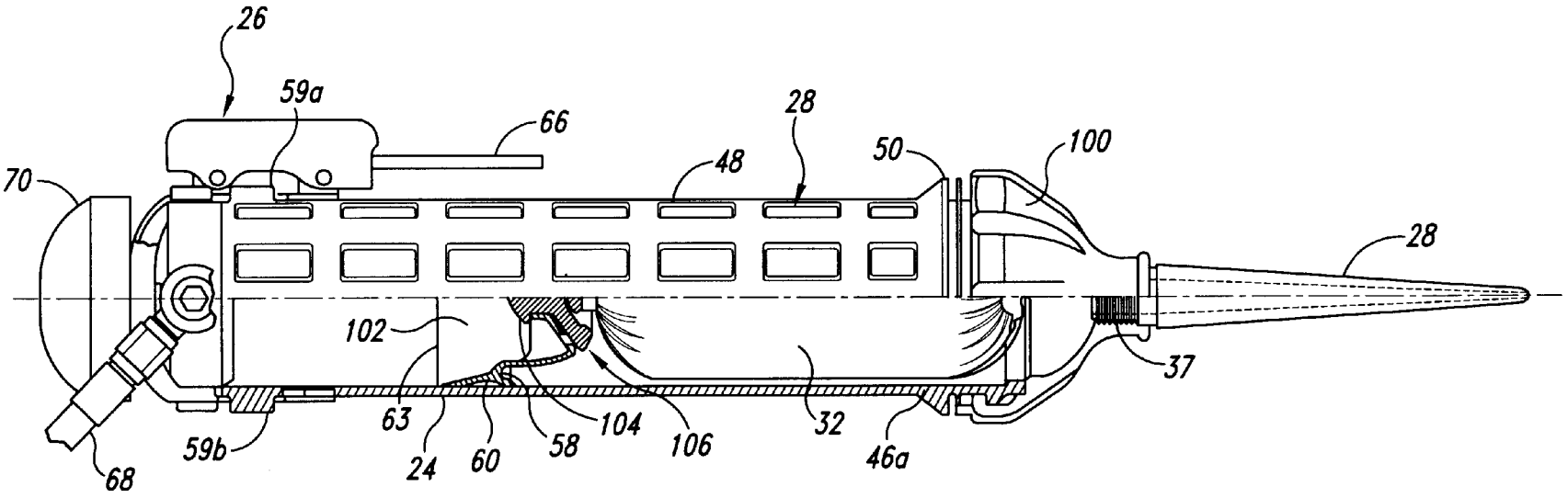
FIG. 10 is a cross-sectional view of the applicator according to the second embodiment.
Figure 11:
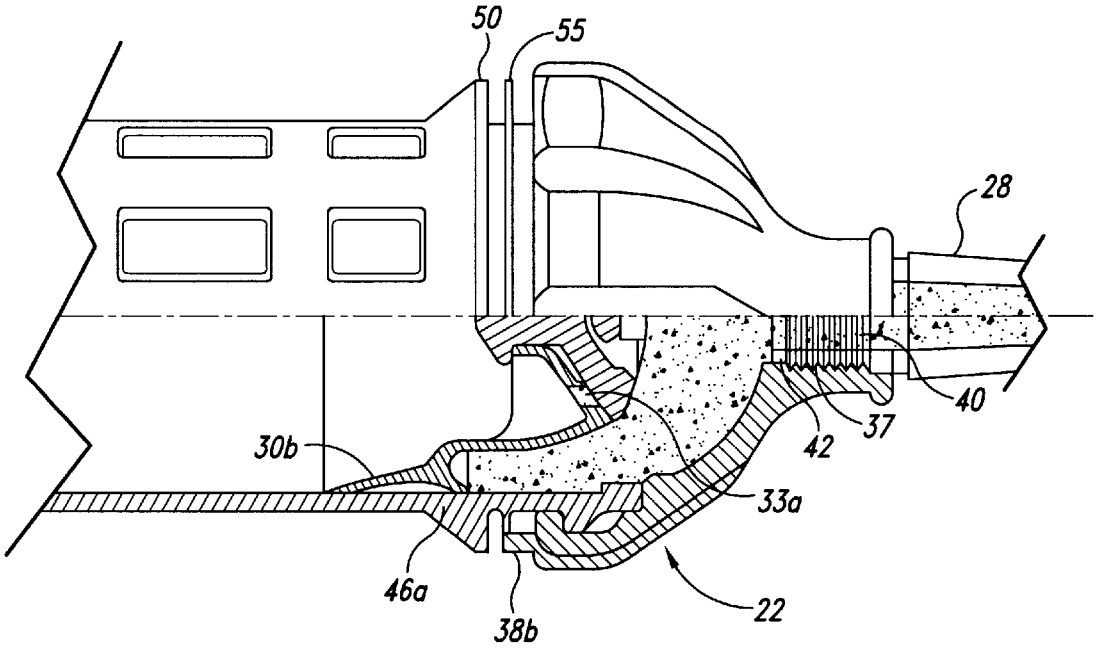
FIG. 11 is a partial cross-sectional view of the cap and a forward portion of the applicator according to the second embodiment.

In a second embodiment, the applicator 20 is identical to the first embodiment, with the exception that a daggerless cap 100, as shown in FIGS. 9, 10, and 11, is used with a cavity-free plunger 102 when the applicator 20 applies highly viscous materials that would not adequately flow through the daggered cap design. The cavity-free plunger 102 is identical to the plunger 32 of the first embodiment, except that the top cavity 62 is replaced by an engaging orifice 104 used to engage a shaped rubber stop 106. The rubber stop 106 is shaped to maximize the pressure applied to the packet 32 to effectively force the viscous fluid out from nozzle tip 28. The shape of the cavity free plunger 102 and the rubber stop 106 are sized to conform to the top of the cap 22.

Figure 12:
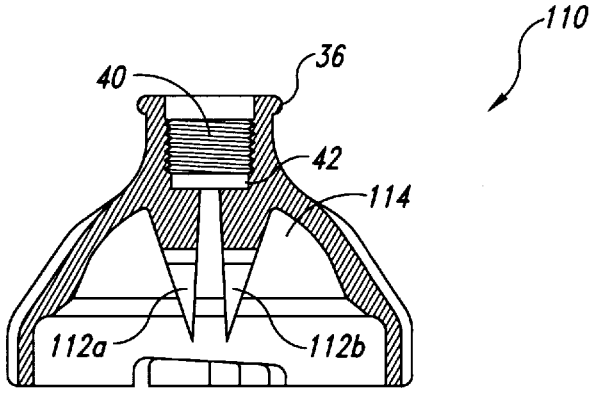
FIG. 12 is a cross-sectional view of a locking cap of an applicator for dispensing a soft packet of material according to a third embodiment of the present invention.
Figure 13:
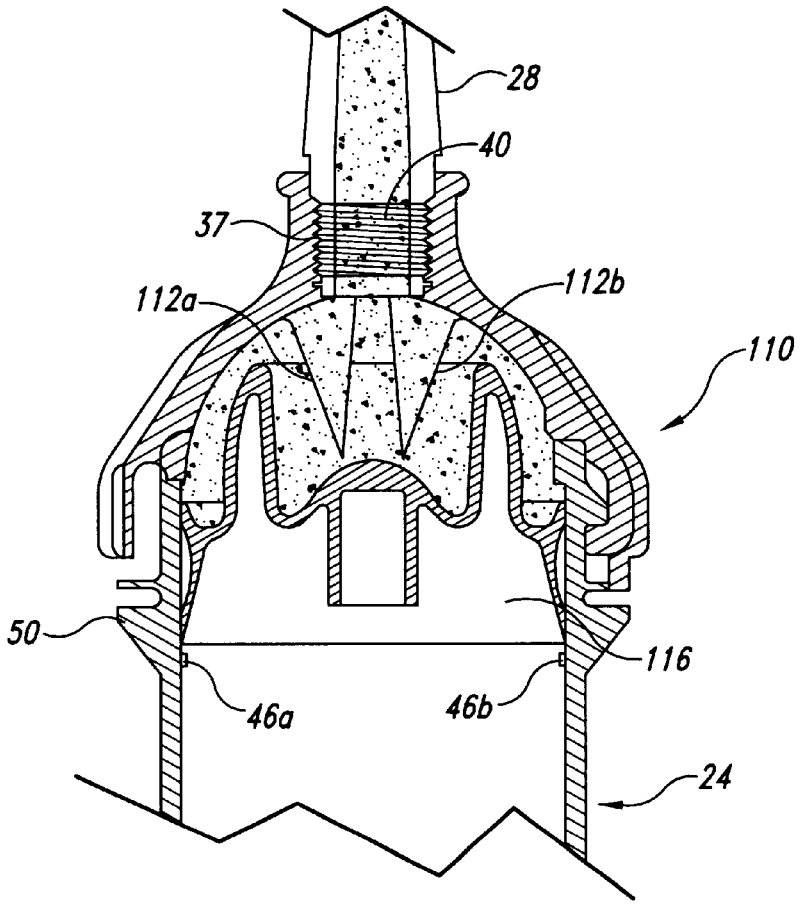
FIG. 13 is a cross-sectional view of the cap and a forward portion of the applicator according to the third embodiment.

In a third embodiment, the applicator 20 is identical to the first embodiment, with the exception that a double dagger cap 110, as shown in FIGS. 12 and 13, is used with the plunger 30 to apply a material. The double daggers 112*a* and 112*b* break and tear the packet 32 simultaneously, spreading open the holes in the packet 32 wide enough until the film of which the packet 32 is made tears between the two holes. The packet 32 then seats against a domed top 114 of the cap 110, creating a seal between the packet 32 and the cap 110. A plunger 116, which is sized to receive the daggers 112*a* and 112*b* and conform to the cap 22, applies pressure to the packet 32. The material flows at the tear between the two daggers 112*a* and 112*b*. Since the product flows in the path of least resistance, it flows down through the daggers 112*a* and 112*b* and out the nozzle 28. Preferably, the two daggers 112*a* and 112*b* have sharp points that are recessed below the edge of the cap 110 providing a margin of safety when handling the cap 110.

Figure 14:
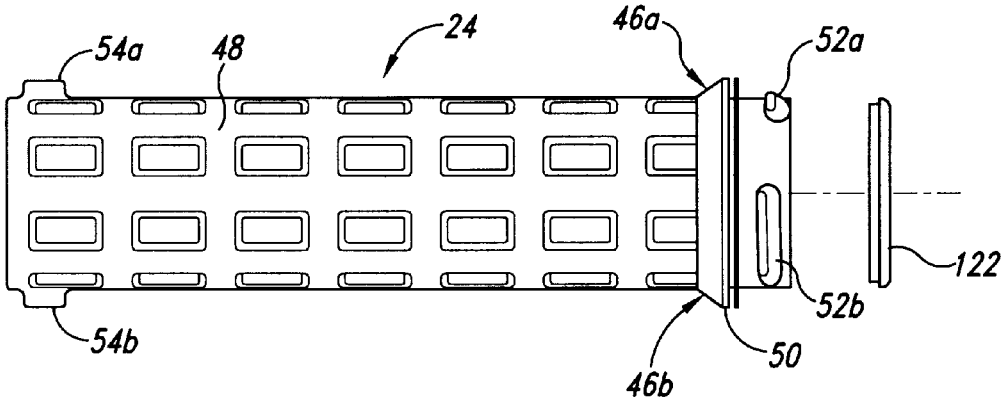
FIG. 14 is a side view of an applicator including a locking ring according to a fourth embodiment of the present invention.

In a fourth embodiment, the applicator 20 is identical to the first embodiment and further includes a stop ring 122, as shown in FIG. 14. The stop ring 122 may also be used to supplement the second and third embodiments.

The ring 122 provides an edge for an internal stop, causing the plunger 30 to stay within the barrel 24, even under conditions of accidental pressurization. The ring 122 has a flat edge on the outer lip, providing a smooth surface and eliminating any possibility of the operator being cut while re-loading the applicator 20 with a new soft packet 32.

In summary, the applicator 20 of the present invention allows the use of the soft packets 32, which contain a material, such as but not limited to a sealant, lubricant, adhesive, or potting compound, that must be applied to a surface. The soft packets 32 allow long-term storage of the material, and can be quickly replaced once spent. Further, the soft packet applicator 20 produces only small amounts of waste. Finally, the arrangement of the plunger and dagger of the first and third embodiments of the applicator 20 and the cap and plunger of the second embodiment allow the operator to extract all the material within the soft packet 32 without clogging the exiting pathway of the fluid.

It will be apparent to those skilled in the art that many changes can be made in the embodiments described above without departing from the scope of the present invention. Thus, the scope of the present invention should not be limited to the structures and methods described in this application, but only by the structures and methods described by the language of the following claims and the equivalents thereof.

What is claimed is:

1. An apparatus that dispenses material stored in a soft packet; said apparatus comprising:

a barrel sized to contain said soft packet, said barrel having a front end and a back end, wherein said barrel includes a tapered lip encircling the front end to protect an operator from sharp edges;

a cap removably engaged to the front end of said barrel, and including an orifice through which the material may flow said cap further including inner dimensions sized to form a seal with a top portion of the soft packet to minimize any extraneous air trapped there between; and a plunger positioned within said barrel, said plunger applying pressure to said soft packet when said plunger moves from the back end of said barrel toward the front end of said barrel to force the material out from the packet and through the orifice.

2. An apparatus that dispenses material stored in a soft packet; said apparatus comprising:

a barrel sized to contain said soft packet, said barrel having a front end and a back end, wherein said barrel includes a continuous thin lip positioned externally between the mounting tabs and the back portion having a plurality of self-locking grooves, and wherein said cap includes a plurality of ramping tongues which when visually aligned with a corresponding one of the self-locking grooves indicates that said cap tabs and said mounting tabs are properly overlapping to ensure reliable engagement between said cap and said barrel;

a cap removably engaged to the front end of said barrel, and including an orifice through which the material may flow, said cap further including inner dimensions sized to form a seal with a top portion of the soft packet to minimize any extraneous air trapped there between, wherein said cap includes a plurality of mounting tabs located along an inner edge of said cap, and wherein said barrel includes a plurality of mounting tabs located along an outer edge of the front end for overlapping with said cap tabs to bayonet mount said cap to said barrel; and a plunger positioned within said barrel, said plunger applying pressure to said soft packet when said plunger moves from the back end of said barrel toward the front end of said barrel to force the material out from the packet and through the orifice.

3. An apparatus that dispenses material stored in a soft packet; said apparatus comprising:

a barrel sized to contain said soft packet, said barrel having a front end and a back end;

a cap removably engaged to the front end of said barrel, and including an orifice through which the material may flow, said cap further including inner dimensions sized to form a seal with a top portion of the soft packet to minimize any extraneous air trapped there between; and a plunger positioned within said barrel, said plunger applying pressure to said soft packet when said plunger moves from the back end of said barrel toward the front end of said barrel to force the material out from the packet and through the orifice;

wherein said barrel includes a plurality of venting orifices proximate the front end allowing egress of air within said barrel when said plunger moves toward the front end.

4. An apparatus that dispenses material stored in a soft packet; said apparatus comprising:

a barrel sized to contain said soft packet, said barrel having a front end and a back end;

a cap removably engaged to the front end of said barrel, and including an orifice through which the material may flow, said cap further including inner dimensions sized to form a seal with a top portion of the soft packet to minimize any extraneous air trapped there between;

a plunger positioned within said barrel, said plunger applying pressure to said soft packet when said plunger moves from the back end of said barrel toward the front end of said barrel to force the material out from the packet and through the orifice; and a stop ring coupled to the front end of said barrel to prevent movement of said plunger from the end into said cap.

5. An apparatus that dispenses material stored in a soft packet; said apparatus comprising:

a barrel sized to contain said soft packet, said barrel having a front end and a back end;

a cap removably engaged to the front end of said barrel, and including an orifice through which the material may flow, said cap further including inner dimensions sized to form a seal with a top portion of the soft packet to minimize any extraneous air trapped there between;

a plunger positioned within said barrel, said plunger applying pressure to said soft packet when said plunger moves from the back end of said barrel toward the front end of said barrel to force the material out from the packet and through the orifice; and a pressurizing valve assembly that forces the movement of said plunger from the back end of said barrel toward the front end of said barrel, wherein pressurizing valve assembly includes:

a fastening means for forming an air-tight seal between a pressurized air source and the back end of said barrel; and an applicator lever that allows air to flow from the air source into a cavity formed between the back end of said barrel and said plunger;

wherein said plunger includes an air valve that allows air to flow from the cavity through to a remaining portion of said barrel to prevent over pressurization of the barrel when the apparatus is unloaded, said air valve including:

a plurality of holes allowing air to pass through said plunger, and a nipple forceable against said plurality of holes to shut off flow of air when the soft packet has been loaded into said barrel.

* * * * *